United States Patent [19]

Sukonnik et al.

[11] Patent Number: 4,711,115

[45] Date of Patent: Dec. 8, 1987

[54] METHOD FOR FORMING MEMORY DISCS BY FORGING

[75] Inventors: Israil M. Sukonnik; John S. Judge, both of Sidney, Ohio; Colin H. Kilgore, New Kensington, Pa.

[73] Assignee: Aluminum Company of America, Pittsburgh, Pa.

[21] Appl. No.: 814,310

[22] Filed: Dec. 30, 1985

[51] Int. Cl.[4] ..... B21D 28/26; B21K 1/76

[52] U.S. Cl. ..... 72/329; 72/327; 72/334; 72/337; 72/47; 72/379; 360/135; 428/579

[58] Field of Search ..... 72/327–330, 72/333–336, 340, 354, 359, 47, 379; 10/86 B, 86 F; 428/579; 360/135

[56] References Cited

U.S. PATENT DOCUMENTS

| | | | |
|---|---|---|---|
| 1,434,190 | 10/1922 | Bird | 72/329 |
| 2,650,886 | 9/1953 | Zelley | 117/130 |
| 2,676,916 | 4/1954 | Zelley | 204/33 |
| 3,554,798 | 1/1971 | Nacci | 117/235 |
| 3,635,067 | 1/1972 | Hanas | 72/329 |
| 3,738,818 | 6/1973 | Stone et al. | 428/579 |
| 4,071,360 | 1/1978 | Mannino, Jr. | 72/329 |
| 4,374,795 | 2/1983 | Keilp et al. | 264/152 |
| 4,393,628 | 7/1983 | Ottman et al. | 51/281 SF |
| 4,412,870 | 11/1983 | Vernam et al. | 148/2 |
| 4,430,387 | 2/1984 | Nakagawa et al. | 428/579 |
| 4,435,343 | 3/1984 | Ando et al. | 264/22 |
| 4,435,973 | 3/1984 | Nakazawa et al. | 72/359 |

FOREIGN PATENT DOCUMENTS

| | | | |
|---|---|---|---|
| 92325 | 10/1983 | European Pat. Off. . | |
| 107421 | 2/1984 | European Pat. Off. . | |
| 38720 | 2/1985 | Japan | 360/135 |
| 105879 | 5/1917 | United Kingdom | 10/86 B |
| 914793 | 1/1963 | United Kingdom | 72/333 |
| 922328 | 3/1963 | United Kingdom | 72/327 |

OTHER PUBLICATIONS

*Metals Handbook,* "Heat Treating, Cleaning and Finishing," ASM Handbook Commitee, American Society for Metals, Ohio, vol. 2, 8th Edition, 1964, p. 599.

*Primary Examiner*—Daniel C. Crane

*Attorney, Agent, or Firm*—Andrew Alexander; John P. Taylor

[57] ABSTRACT

A flat, smooth material, e.g., metal sheet, suitable for use as a disc substrate for applying a recording media thereto for data storage devices, and a method of making same, are disclosed. The flat and smooth substrate is formed by applying sufficient pressure to opposite surfaces of the material to achieve the desired flatness and smoothness prior to finishing. Subsequent finishing may be used to remove any zone of roughness which may be present in the surfaces of the disc resulting from the pressing step. In one embodiment, the pressure step may be applied before finishing the disc perimeters.

8 Claims, 10 Drawing Figures

METHOD FOR FORMING MEMORY DISCS BY FORGING

BACKGROUND OF THE INVENTION

1. Field of the Invention

This invention relates to the production of memory discs. More particularly, this invention relates to the production of very flat and smooth memory discs useful as information storage devices for computers or the like.

2. Description of the Prior Art

In the conventional production of a metal memory disc such as a so called "hard disc" useful for mass storage of data in the computer industry, an initial metal blank is stamped from a metal strip, mechanically machined, and then coated with a material containing magnetizable particles such as iron oxide. It is very important that the final product be very flat and smooth when used for such a purpose since read-write heads used with such storage devices are positioned so close to the disc that even the presence of smoke particles can result in an interference between the disc and the head resulting in a so-called "head crash".

Ottman et al. U.S. Pat. No. 4,393,628 discusses this need for a very flat and smooth disc and conclude that the conventional diamond machining of the disc is not sufficient to provide the needed smooth surface. The patentees point out that such machining, while providing a mirror-like finish, does include topography having a maximum peak to valley dimension that is 10 to 20 percent of the thickness of some coatings subsequently applied to the disc. They further observe that such variations in topography may be as much as 20 to 40 percent of some proposed coatings which could result in unacceptable localized thinning of the subsequent coating. A polishing step is therefore proposed to supplement the initial machining step.

Vernam et al. U.S. Pat. No. 4,412,870, assigned to the assignee of this invention, recognize that some difficulties with the machining of such discs may be the result of the presence of insoluble alloy constituents such as Al-Fe-Mn-Si phases in an aluminum base alloy. The patentees describe and claim an improved disc using a new aluminum wrought alloy and methods for making the alloy and the disc to provide a more machinable product.

However, it has been recognized that it would be economically advantageous to eliminate or minimize the surface machining step entirely, or at least restrict such to merely machining of the edges to maintain the diameter integrity of the disc, relying mainly on pressure steps for the desired flatness and smoothness of the disc.

An alternate approach proposed in European patent application Nos. 92,325 and 107,421 involves stretching a nonmetallic recording film across a rigid disc or substrate and relying on the created tension to provide the desired flatness.

The use of nonmetallic recording discs has also been shown in U.S. Pat. Nos. 3,554,798, 4,374,795 and 4,435,343 wherein the use of materials such as plastic are used. However, the use of such materials, particularly in applications such as so-called "floppy discs", has shown that such materials are not as durable as coated metal discs.

SUMMARY OF THE INVENTION

It is, therefore, the object of this invention to provide a method of producing a memory disc substrate, e.g., metal substrate, with sufficient flatness and smoothness to reduce or eliminate the need for further smoothing of the surface with machining or polishing operations.

It is another object of this invention to provide a method of producing a metal disc with sufficient flatness and smoothness for use as a recording medium substrate which eliminates or minimizes machining or polishing of the surface by using a pressing method which does not result in the formation of rough areas in the working surface.

It is yet another object of this invention to provide a method of producing a flat and smooth metal disc using a pressing method which does not result in the formation of rough areas in the working surface by causing substantially all of the metal flow which occurs during the pressing operation to be radially outward.

It is a further object of this invention to provide a method of producing a flat and smooth metal disc using a pressing method which results in the formation of a neutral area of roughness adjacent the center of the metal disc which is subsequently eliminated by forming a center opening of desired diameter in the disc after the pressing step.

These and other objects of the invention will be apparent from the following description and accompanying drawings.

In accordance with the invention, a flat, smooth memory disc substrate is obtained by applying sufficient pressure to opposite surfaces of the substrate material, e.g., metal sheet, to achieve the desired flatness and smoothness prior to providing the disc with the desired inside and outside diameter requirements. In one embodiment, the pressure step is applied before blanking the disc perimeter.

DETAILED DESCRIPTION OF THE INVENTION

The invention provides a flat disc having a maximum profit flatness difference of 2000 Angstroms from the lowest spot to the highest spot on the disc and a smoothness defined as Ra (roughness average) equal to or less than 350, preferably 250 Angstroms. The flat and smooth characteristics of the disc can be obtained by a pressing operation normally without the need for machining of the disc surfaces to obtain the required flatness although some finishing of the surface may be performed if desired. Further, the edges of the disc may be subjected to finishing, e.g. machining or fine blanking to provide the disc with desired inner diameter and outer diameter requirements. This pressing operation, which may also be referred to as an impressing or an open forging, is conducted by placing a sheet of the metal from which the disc is to be constructed into a press and exerting a pressure of from 0.5 KSI to about 2200 KSI total against the opposite surfaces of the metal sheet. The resulting disc, after blanking to form both the desired outer diameter and the central opening, is suitable for use as a memory or storage disc in a data storage device for a computer or the like.

An important characteristic of the present invention is that the finished central opening used for driving or spinning the disc in a memory drive is not formed until after the pressing operation is conducted. The importance of this feature is illustrated in FIGS. 2 and 3 wherein this aspect of the invention is characterized in its simplest form.

Figure 1:
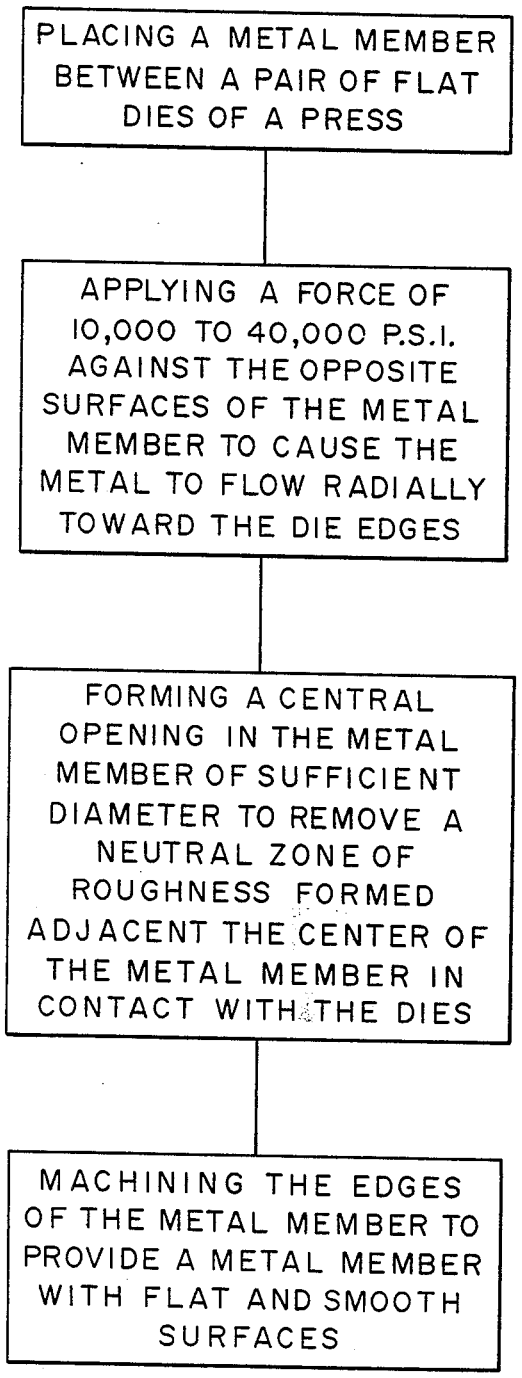
FIG. 1 is a flow sheet illustrating the process of the invention.
Figure 2:
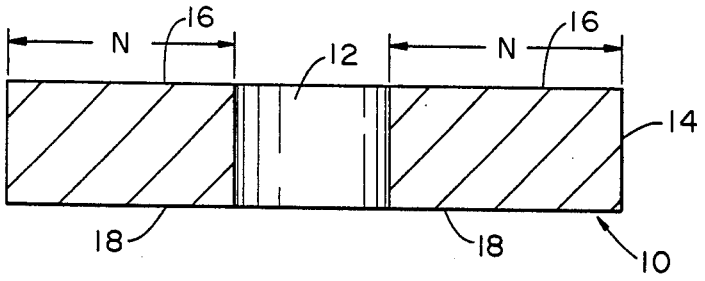
FIG. 2 is a vertical cross-sectional view of the metal flow showing the position of the neutral zone when the central opening is formed prior to the pressing step.

It will be seen in FIG. 2 that exerting a downward force against the upper surface 16 of a preformed disc 10 and, at the same time exerting an upward force against lower surface 18 of disc 10, will result in the flow of metal either toward the cut out central opening 12 or toward the outer edge 14 of disc 10. In one embodiment, the direction of metal flow will depend upon the proximity of the particular portion of metal to either the outer edge 14 or central opening 12. In another embodiment, the direction of metal flow can be influenced or controlled by tool design, that is, depending on whether the dies have a crowned or tapered surface. At some point on or close to the disc surface, the metal will flow in neither direction. This point, or area, N in FIG. 1, is designated as a neutral point or sticking point. In this region, the metal, at both surfaces 16 and 18, may be rough and machining, such as practiced in the prior art, will be necessary if the eventual product is to be used as a data storage disc.

Figure 3:
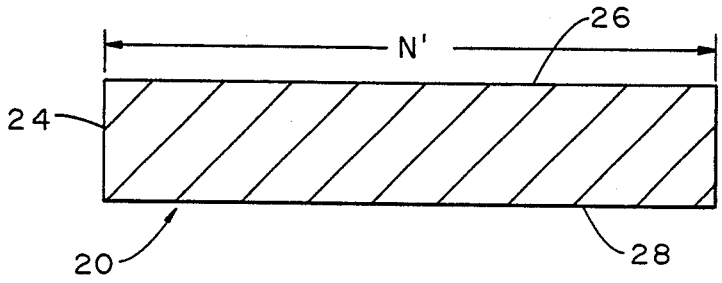
FIG. 3 is a vertical cross-sectional view of the metal flow showing the position of the neutral zone formed in the practice of the invention.

If the pressing operation is carried out prior to forming the desired central opening, the metal under pressure, as shown in FIG. 3, will, in accordance with the practice of the invention, all flow outwardly toward an end edge 24 of disc 20. This creates a neutral point or area N' at or adjacent to the center of the disc. Subsequent formation of the central opening of disc 20 removes the rough area which characterizes this neutral point. Discs 10 and 20 are suitable for use in mass data storage devices without machining of surfaces 26 and 28 although it may be necessary to finish the inner diameter and outer diameter to the required dimensions.

Figure 4:
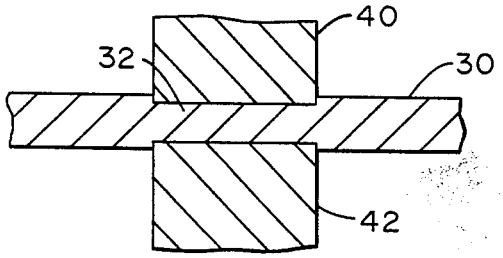
FIGS. 4–6 are vertical cross-sectional views of sequential steps in the practice of the preferred embodiment of the invention.
Figure 5:
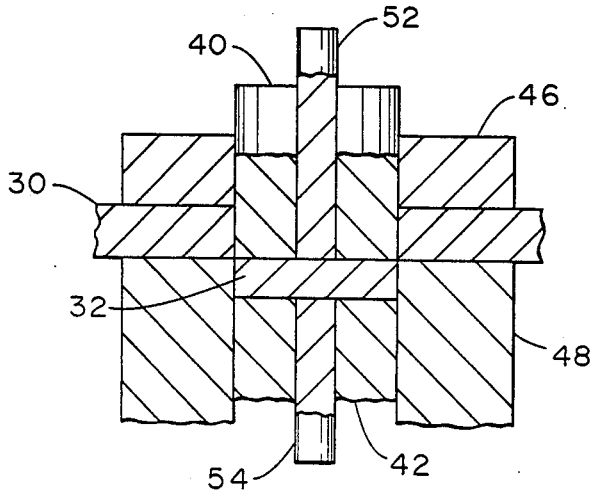
Figure 6:
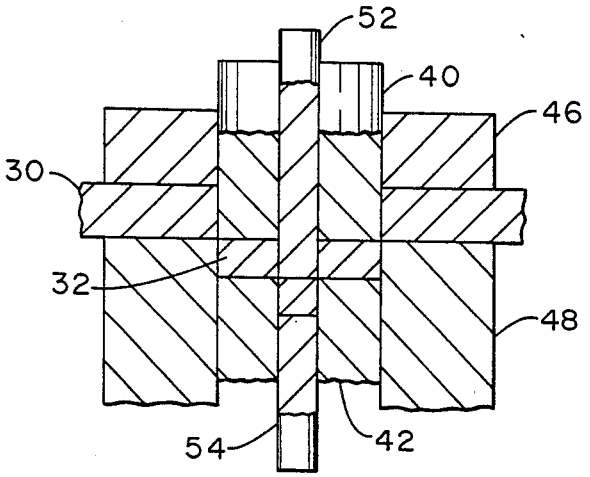

Turning now to FIGS. 4–6, formation of the disc of the invention is shown sequentially. In FIG. 4, a metal sheet 30 is shown between an upper die 40 and a lower die 42 of a press (not shown). In this step, the dies, upon closing of the press, exert a pressure which may be as much as 2200 KSI against the upper and lower surfaces of disc portion 32 of sheet 30 between dies 40 and 42.

Dies 40 and 42 can be of circular cross-section with a diameter slightly larger than the desired diameter of the disc to be formed. However, other shaped dies, e.g. square or multi-sided, may be used. In addition, while the working surface can be flat, in certain instances, it may be advantageous to use crowned or tapered working surfaces to facilitate metal flow. It will be noted, however, that in this embodiment of the invention, not only has the center opening not yet been formed but neither has disc portion 32 been blanked out from sheet 30.

After disc portion 32 has been pressed, it is blanked from the remainder of sheet 30 by engagement of sheet 30 with a set of cylindrical blanking dies 40 and 42 (FIG. 5). The blanking dies, after being brought into contact with sheet 30, are then moved vertically either up or down to separate disc portion 32 from sheet 30. Preferably, dies 40 and 42 remain in contact with disc portion 32 and maintain pressure on the disc's surface during the blanking step to maintain the desired flatness of the disc, sometimes referred to as a fine blanking operation.

As shown in FIG. 6, the center portion of disc 32 is removed by action of center punch dies 52 and 54 which have a diameter corresponding to the desired central opening of disc 32. Again, pressure is preferably maintained on disc 32 by dies 40 and 42 during formation of the central opening in disc 32. This step can remove any rough surface areas caused by formation of any neutral or sticking point which may occur during the pressing step since the neutral point or zone is normally thought to occur in the central area of disc 32.

After fine blanking of disc 32 and formation of the central opening therein, disc 32 may be removed from the press. The edges of disc 32 may then be machined, if necessary, both to smooth the edges as well as to maintain the dimensional tolerance of both the outer and central opening diameters.

It should be noted that while the outer blanking and central opening formation steps have been shown as separate steps for illustrative purposes, these steps may be carried out substantially simultaneously. It must also be pointed out that the blanking steps could be carried out on a different apparatus from that used in the pressing step. The same apparatus may be used for all the steps using multiple dies both from the standpoint of economics as well as to maintain pressure on disc portion 32 of sheet 30 during the blanking operations to insure maintenance of the flatness and smoothness attained during the pressing step.

Sheet 30 may comprise any metal or composite sufficiently malleable to be capable of being pressed into the desired flat and smooth sheet and possessing sufficient rigidity to maintain this shape after pressing. Preferably, sheet 30 comprises an aluminum alloy such as Aluminum Association (AA) alloy 5086 or 3003, for example. Sheet 30 also may comprise a clad or composite material with a higher strength alloy used as the substrate or core material and a softer alloy such as AA alloy 1100, 1145 or 1230 on the surfaces to facilitate the pressing operation. It is also within the scope of the invention to provide a nonmetallic coating on the surface of the disc and use the method of the invention to provide the desired flatness and smoothness. It will be understood that the use of nonmetallic material can result in the use of much lower pressing pressure to provide the desired flatness and smoothness.

The thickness of sheet 30 prior to the pressing step is about 0.030 to 0.165 inch. Preferably, the pressing operation reduces the thickness of disc portion 32 in sheet 30 about 0.004 to 0.0006 inch.

The outer diameter of disc 32 will vary considerably with the intended use of the disc since memory discs commonly vary from as small as 3 inches to as much as 14 inches in diameter. The diameter of the central opening also may vary somewhat, but usually will be in the range of from 1 to 4 inches. While the above described embodiment of the invention is applicable to any reasonable diameter disc, the diameter of disc 32 will affect the amount of pressure needed to force the desired metal flow. Furthermore, as will be described below, the relative diameters of the central opening and the outside edge of the disc may effect the applicability of another embodiment of the invention.

The pressing step may be carried out at room temperature. However, it is within the scope of this invention to raise the temperature of sheet 30 during the pressing step to ease the flow of the metal to provide for hot working.

Figure 7:
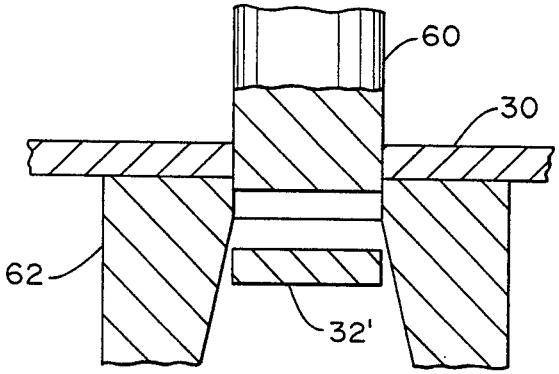
FIGS. 7–9 are vertical cross-sectional views of sequential steps an alternate embodiment of the invention.
Figure 8:
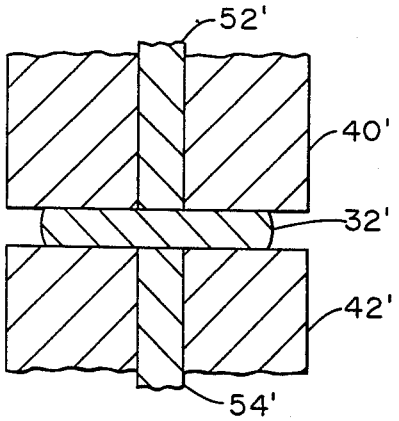
Figure 9:
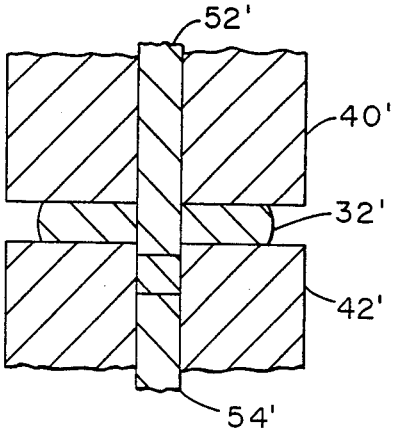

In FIGS. 7 to 9, an alternate embodiment is illustrated in which the blanking step to form disc 32' is carried out prior to the pressing step.

As shown in FIG. 7, disc blank 32' is punched out from sheet 30 in a press (not shown) using a punch 60 and die 62. In this embodiment, since the pressing operation will be carried out in a subsequent step and the diameter of disc blank 32' may increase during the pressing step, the initial blanking step may be a simple stamping operation where the edges of disc blank 32' are not necessarily as cleanly cut as in the previous embodiment.

Disc blank 32' is then placed between press dies 40' and 42' and pressed at a pressure of 500 to 2200 KSI as in the first embodiment to produce the desired flatness in disc 32'. After the pressing step, the center opening in disc 32' is formed in FIG. 9 in similar fashion to that described in the previous embodiment illustrated in FIG. 6.

The edges of disc 32' are then machined or finished to the desired diameter, to provide a final product similar to that of the first embodiment. As in the first embodiment, the rough portions of both surfaces caused by formation of the neutral or sticking point in the pressing step are removed by formation or finishing of the central opening in disc 32'.

Figure 10:
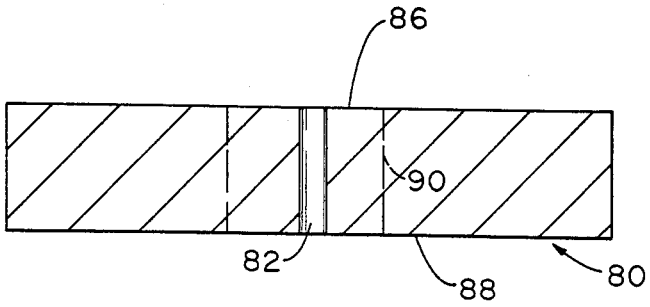
FIG. 10 is a vertical cross-sectional view of another alternate embodiment of the invention.

Turning now to FIG. 10, a modification of the previous embodiments is illustrated wherein a disc 80 is provided with a small center opening 82 prior to the pressing step. Also shown, in dotted lines, is opening 90 conforming to the diameter of the final central opening which will be formed in disc 80 after the pressing step.

The purpose of opening 82 is to deliberately permit the metal to flow toward the middle as well as toward the edges to thereby lower the total pressure needed to obtain the desired metal flow. It will be noted that the presence of opening 82 causes the metal to flow both inwardly and outwardly forming a neutral zone in the surfaces 86 and 88 of disc 80. However, by making the central opening 82 of very small diameter, relative to the overall diameter of disc 80 and the diameter of the final opening to be formed after the pressing step, the neutral zones of roughness may be caused to form in the area which will be subsequently removed to form opening 90.

However, as referred to earlier in the description, the relative diameters of the central opening and the outside edge of the disc may affect the applicability of this embodiment of the invention since the neutral zone formed adjacent the middle of the disc must be removable by the formation of central opening 90 else further machining of the surfaces of disc 80 may be necessary.

Thus, the invention provides a flat and smooth metal disc suitable for use as a data storage device which is produced without the need for costly and time consuming machining of the surfaces of a metal blank to obtain the desired flatness and smoothness.

Having thus described the invention, what is claimed is:

1. A method of making a flat and smooth metal memory disc for a data storage system which comprises:

(a) pressing opposite surfaces of a metal member at a pressure of up to 2,200 KSI to form surfaces characterized by a maximum difference of 50 to 300 micro-inches from the lowest spot to the highest spot and a smoothness defined as Ra equal to or less than 350 Angstroms by flowing the metal member radially outward from a central neutral zone of roughness; and (b) subsequently removing said neutral zone of roughess formed during said pressing step by forming a central opening in said metal member of a diameter sufficient to remove said neutral zone of roughness;

whereby said memory disc will be formed sufficiently smooth and flat to permit use of said memory disc without further machining of said surfaces to achieve said flatness and smoothness.

2. The process of claim 1 wherein said step of removing said neutral zone of roughness and forming said central opening is carried out while maintaining pressure against said surfaces to preserve said flatness and smoothness obtained in said pressing step.

3. The process of claim 2 including the further step of blanking said memory disc from said metal member after said pressing step.

4. The process of claim 3 wherein said step of blanking said memory disc from said metal member is carried out while maintaining pressure against said surfaces to preserve said flatness and smoothness obtained in said pressing step.

5. The process of claim 1 including the further step of blanking said memory disc from said metal member prior to said pressing step.

6. The process of claim 1 including the further step of smoothing the edges of said memory disc after forming said central opening therein.

7. The process of claim 1 including the further step of forming a first opening in said metal member prior to said pressing step of smaller diameter than said central opening of predetermined diameter to thereby permit limited movement of said metal under pressure toward the center of said metal member, said first opening being sufficiently small to prevent a radially outward shift of said neutral zone of roughness created during said pressing step to a distance exceeding the radius of said subsequently formed central opening, whereby formation of said central opening will still remove said rough areas of said neutral zone.

8. A method of making a flat and smooth aluminum memory disc for a data storage system which comprises:

(a) pressing opposite surfaces of a portion of an aluminum base alloy sheet at a pressure of from about 500 to 2200 KSI to flatten and smooth the surfaces sufficiently to form one or more surfaces on said sheet characterized by a maximum difference of 2000 Angstroms from the lowest spot to the highest spot and a smoothness defined as Ra equal to or less 350 Angstroms to permit usage of said surfaces in a data storage system without the need for further machining of said surfaces to achieve the desired flatness and smoothness;

(b) blanking an aluminum memory disc from said portion of said aluminum base alloy sheet while maintaining said pressure on said portion;

(c) removing a central neutral zone of roughness formed in said aluminum memory disc during said pressing step by the radially outward flowing of said aluminum by forming a central opening of sufficient diameter to remove said zone of roughness in said portion of said aluminum memory disc after said pressing step while maintaining pressure on said aluminum memory disc; and (d) smoothing the edges of said aluminum memory disc after said steps of blanking and forming said central opening; whereby said aluminum memory disc is formed with the required flatness and smoothness without machining the surfaces of said aluminum memory disc.

* * * * *